US006411177B1

(12) United States Patent
Tada et al.

(10) Patent No.: US 6,411,177 B1
(45) Date of Patent: Jun. 25, 2002

(54) DIELECTRIC FILTER, DIELECTRIC DUPLEXER, AND COMMUNICATION APPARATUS

(75) Inventors: Hitoshi Tada; Hideyuki Kato; Motoharu Hiroshima, all of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/493,561

(22) Filed: Jan. 28, 2000

(30) Foreign Application Priority Data

Jan. 28, 1999 (JP) ..... 11-019767

(51) Int. Cl.[7] ..... H01P 1/20; H01P 1/202
(52) U.S. Cl. ..... 333/134; 333/202; 333/206
(58) Field of Search ..... 333/206, 134, 333/219, 202

(56) References Cited

U.S. PATENT DOCUMENTS

| | | | | |
|---|---|---|---|---|
| 3,798,578 A | * | 3/1974 | Konishi et al. | 333/229 |
| 4,890,079 A | | 12/1989 | Sasaki | |
| 5,057,466 A | * | 10/1991 | Sugiyama et al. | 501/135 |
| 5,292,694 A | * | 3/1994 | Abe et al. | 501/139 |
| 5,332,984 A | * | 7/1994 | Abe et al. | 333/219 |
| 5,864,264 A | * | 1/1999 | Hino | 333/206 |

FOREIGN PATENT DOCUMENTS

| | | |
|---|---|---|
| JP | 03-250901 | 11/1991 |
| JP | 04-104946 | 4/1992 |
| JP | 06-310903 | 11/1994 |

OTHER PUBLICATIONS

European Search Report dated Feb. 11, 2002.

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

There is disclosed a dielectric filter comprising: an attenuation band in proximity to a pass band; a threshold-frequency position of a determined maximum insertion loss being arranged close to a shoulder portion of a waveform exhibiting pass characteristics in which insertion losses increase in a region from the pass band to the attenuation band; temperature characteristics of a dielectric material being determined in such a manner that the shoulder portion moves toward the attenuation-band direction according to an increase and decrease in temperature.

In the above dielectric filter, the deterioration of insertion-loss characteristics with respect to temperature changes is improved so that good characteristics are exhibited over a wide range of temperatures.

9 Claims, 10 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter, a dielectric duplexer, and a communication apparatus incorporating the same, in which a dielectric material is used in a resonator part.

2. Description of the Related Art

Generally, for example, when a dielectric duplexer is formed by disposing a plurality of dielectric resonators in a dielectric block, a plurality of resonant-line holes are arranged in the dielectric block to form resonant lines on the inner surfaces of the holes, by which there are provided a transmitting filter section, in which signals of a transmitting band are allowed to pass through and signals of a receiving band are attenuated, and a receiving filter section, in which signals of the receiving band are allowed to pass through and signals of the transmitting band are attenuated.

When the transmitting filter and the receiving filter are band-pass type filters, pass characteristics of the filters are as shown in FIGS. 14A and 14B. In this case, the symbol Tx denotes the pass characteristics of the transmitting filter, and the symbol Rx denotes the pass characteristics of the receiving filter. As indicated by hatching F1, F2, F3 and F4 in the figures, a maximum insertion loss in a transmitting band (F1) and a minimum insertion loss in a receiving band (F2) are determined as the characteristics of the transmitting filter, whereas a maximum insertion loss in the receiving band (F3) and a minimum insertion loss in the transmitting band (F4) are determined as the characteristics of the receiving filter. The transmitting filter and the receiving filter are designed so that they can satisfy these conditions.

However, the pass characteristics shown in FIGS. 14A and 14B are the characteristics at a specified temperature. In general, in dielectric filters and dielectric duplexers, the higher the temperature, the more the unloaded Q factor (Qo) of a resonator is deteriorated. This is due to the temperature characteristics of electrode materials. For example, in the case of silver or copper, conductivity decreases by approximately 2% with an increase of every 10° C. The conductivity decrease of the electrode directly leads to the deterioration of Qo. As a result, the higher the temperature, the more the insertion loss of the filter is deteriorated.

In general, since the characteristics of a pass band are determined by a maximum insertion loss and a region specifying a frequency range (from one threshold frequency to the other threshold frequency) thereof, both shoulder portions of the pass band characteristics (the portions A and B shown in FIGS. 14A and 14B) are in proximity to the ends of the region. In addition, in the case of a duplexer, since a transmitting band and a receiving band are conventionally in proximity to each other, the shoulder portion in a range from the pass band to the attenuation band thereof is the closest to the end of a side close to the attenuation band in a region specifying the maximum insertion loss and the frequency range thereof (the position indicating the maximum insertion loss and the frequency range is hereinafter referred to as a "threshold").

For example, the filter (the transmitting filter) on the lower-frequency side of the pass band has a threshold on the higher-frequency side of the pass band, as shown at a portion A FIG. 14A. The filter (the receiving filter) on the higher-frequency side of the pass band has a threshold on the lower-frequency side of the pass band, as shown at a portion B.

In this case, when the temperature of the dielectric duplexer is increased, Qo of a resonator is deteriorated due to the above-described reason, by which insertion losses are increased as indicated by dotted lines in FIG. 14A. Furthermore, when the temperature is over a certain degree, both the high-frequency side shoulder portion of the pass characteristics of the transmitting filter and the low-frequency side shoulder portion of the pass characteristics of the receiving filter go beyond the maximum insertion loss at each of the thresholds.

Although the example shown in FIG. 14A illustrates a case where the permittivity-temperature characteristics of the dielectric material are fixed (in which permittivity does not change regardless of temperature changes), when the dielectric material has permittivity-temperature characteristics, as shown in FIG. 14B, according to the inclination of the characteristics, the pass characteristics move toward either the high-frequency side or the low-frequency side. For example, when the higher the temperature is the lower the permittivity so that the resonant frequency is increased, pass characteristics as indicated by dotted lines in FIG. 14B are exhibited. In this case, the shoulder portion of the pass characteristics of the receiving filter having an attenuation band on the lower-frequency side goes beyond the maximum insertion loss of the threshold, as shown at the portion B. Furthermore, as shown in FIG. 14A, the waveform of the pass characteristics does not only move toward the lower direction, but it moves toward the right-lower slanting direction in the figure. Therefore, the problems described above occur even at relatively low temperatures.

The above-described problems occur not only in the case of a dielectric duplexer, but the problems also occur in the case of a single dielectric filter in which a threshold is in proximity to the shoulder portion where insertion losses increase in a region from the pass band to the attenuation band.

SUMMARY OF THE INVENTION

To overcome the above described problems, preferred embodiments of the present invention provide a dielectric filter, a dielectric duplexer, and a communication apparatus incorporating the same, in which deterioration of insertion-loss characteristics with respect to temperature changes is improved so that good characteristics are exhibited over a wide range of temperatures. In this invention, even if temperature changes occur in a dielectric filter or a dielectric duplexer, a waveform exhibiting the pass characteristics of the device is moved in such a manner that the waveform does not go beyond a threshold determined by a maximum insertion loss and a threshold frequency thereof.

One preferred embodiment of the present invention provides a dielectric filter having an attenuation band in proximity to a pass band, a threshold-frequency position of a determined maximum insertion loss being arranged close to a shoulder portion of a waveform exhibiting pass characteristics in which insertion losses increase in a region from the pass band to the attenuation band. In this dielectric filter, temperature characteristics of a dielectric material are determined in such a manner that the shoulder portion moves toward the attenuation-band direction according to an increase and decrease in temperature. With this arrangement, even if the pass characteristics of the filter change according to an increase and decrease in temperature, since the shoulder portion in the region from the pass band to the attenuation band moves in such a manner that they avoid a threshold, by which specified characteristics can be maintained.

The above described dielectric filter may be formed by a plurality of dielectric resonators, at least one of the dielectric resonators being a trap resonator forming an attenuation pole in a region from the shoulder portion to the attenuation band. In addition, the temperature characteristics of the dielectric material are determined in such a manner that resonant-frequency changes with respect to temperature changes in the trap resonator are smaller than those with respect to temperature changes in the other dielectric resonator. With this arrangement, attenuation characteristics near the attenuation pole are fixed regardless of temperature changes, so that specified attenuation characteristics can be maintained.

Furthermore, the plurality of the dielectric resonators may be integrally molded or integrally fired as a single dielectric block. Although there is a problem in that, if a dielectric filter is formed by combining discrete dielectric resonators, an error in the arrangement occurs, since the difference in the temperature characteristics of a dielectric material cannot be judged from the appearance, the present invention can solve the problem.

The above described dielectric filter may be a band pass filter formed by a plurality of dielectric resonators in which the pass band is used as the range of a resonant frequency. With this arrangement, the insertion loss of the pass band is smaller and the insertion loss at the shoulder portion of the pass band adjacent to the attenuation band can be maintained at a low level over a wide range of temperatures.

The dielectric filter may be a band block filter formed by a plurality of dielectric resonators in which the attenuation band is used as the range of a resonant frequency. With this arrangement, a large amount of attenuation in the attenuation band can be obtained, and at the same time, the insertion loss at the shoulder portion of the pass band adjacent to the attenuation band can be maintained at a low level over a wide range of temperatures.

Another preferred embodiment of the present invention provides a dielectric duplexer including the above-described two dielectric filters, one of the two filters being a dielectric filter in which the low-frequency band of the filter is an attenuation band and the high-frequency band thereof is a pass band, and the other filter being a dielectric filter in which the low-frequency band of the filter is a pass band and the high-frequency band thereof is an attenuation band. With this arrangement, in both filters, the shoulder portion of the pass characteristics in the region from the pass band to the attenuation band does not go beyond a maximum insertion loss over a wide range of temperatures, by which the functions of the duplexer can be maintained. In addition, in this dielectric duplexer, when the two dielectric filters are integrally molded or integrally fired by a single dielectric block, the above-described error in the arrangement does not occur.

Yet another preferred embodiment of the present invention provides a communication apparatus including one of the dielectric filter and the dielectric duplexer described above, which is disposed in a high-frequency circuit section. With this arrangement, a communication apparatus in which a specified signal-processing function of the high-frequency circuit section can be maintained over a wider range of temperatures.

Other features and advantages of the present invention will become apparent from the following description of the invention which refers to the accompanying drawings.

DESCRIPTION OF THE PREFERRED EMBODIMENTS

The structure of a dielectric filter according to a first embodiment of the present invention will be illustrated by referring to FIGS. 1A to 4.

Figure 1A:
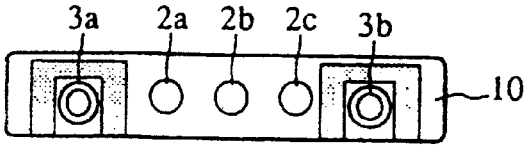
FIGS. 1A, 1B, 1C and 1D are projection views of a diaelectric filter according to a first embodiment of the present invention.
Figure 1B:
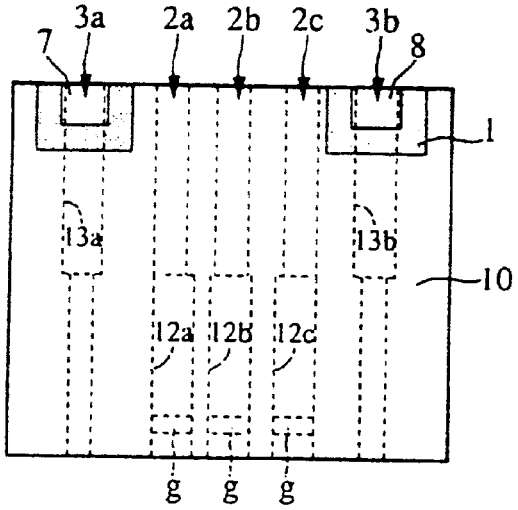
Figure 1D:
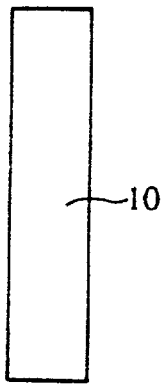
Figure 1C:
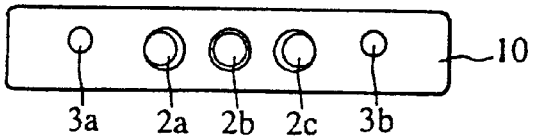

FIGS. 1A to 1D are projection views of the dielectric filter, in which FIG. 1A is a plan view, FIG. 1B is a front view, FIG. 1C is a bottom view, and FIG. 1D is a right side view. When the dielectric filter is mounted on a printed circuit board as a component, the front view shown in FIG. 1B is a surface mounted, with respect to the printed circuit board.

This dielectric filter is formed by disposing various holes and electrodes with respect to a rectangular parallelepiped dielectric block 1. More particularly, reference numerals 2*a*, 2*b*, and 2*c* denote resonant-line holes, on the inner surfaces of which resonant lines 12*a*, 12*b*, and 12*c* are formed. In addition, reference numerals 3*a* and 3*b* denote input/output coupling line holes, on the inner surfaces of which input/output coupling lines 13*a* and 13*b* are formed. These holes are stepped holes where the inner diameters of the through-holes are changed at certain points thereof. On the outer surfaces of a dielectric block 1, input/output terminals 7 and 8 continuing from the input/output coupling lines 13*a* and 13*b* are formed, and on substantially the entire surfaces (six faces) except these input/output terminals, ground electrodes 10 are formed. In addition, on the resonant lines 12*a*, 12*b*, and 12*c*, electrodeless portions (non-conductive portions) indicated by "g" are disposed near the ends of the large inner-diameter sides of the stepped holes to generate stray capacitances (Cs) at these parts.

The operations of the dielectric filter having the above structure will be described. First, the resonant lines 12*a*, 12*b*, and 12*c* formed in the resonant-line holes 2*a*, 2*b*, and 2*c* are capacitively coupled. In other words, the resonant lines 12*a*, 12*b*, and 12*c* are coupled by a combination of the comb-line coupling (inductive coupling) formed by the above Cs and the capacitive coupling formed by the stepped holes. In this case, since a relationship of the inductive coupling<the capacitive coupling is provided, the resonant lines 12*a*, 12*b*, and 12*c* are capacitively coupled overall. Interdigital coupling is each formed between the resonant line 12*a* and the input/output coupling line 13*a* and between the resonant line 12*c* and the input/output coupling line 13*b*. With this arrangement, the part between the input terminals 7 and 8 serves as a band pass filter.

Figure 2:
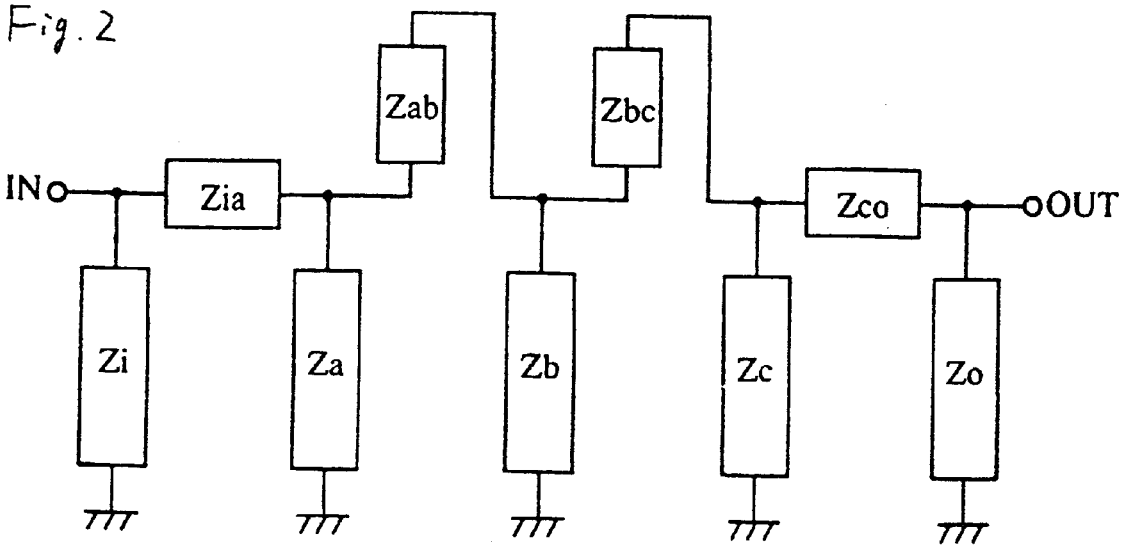
FIG. 2 is an equivalent circuit diagram of the dielectric filter.

FIG. 2 is an equivalent circuit diagram of the dielectric filter. In this figure, the symbols Za, Zb, and Zc denote impedances generated by the resonant lines 12*a*, 12*b*, and 12*c* shown in FIG. 1, and the symbols Zi and Zo denote impedances generated by the input/output coupling lines 13*a* and 13*b* shown in FIG. 1. In addition, the symbol Zia denotes an impedance generated by a mutual capacitance generated between the resonant line 12*a* and the input/output coupling line 13*a*, the symbol Zco denotes an impedance generated by a mutual capacitance generated between the resonant line 12*c* and the input/output coupling line 13*b*. Furthermore, the symbol Zab denotes an impedance generated by a mutual capacitance generated between the resonant lines 12*a* and 12*b*, and the symbol Zbc denotes an impedance generated by a mutual capacitance between the resonant lines 12*b* and 12*c*.

Figure 3A:
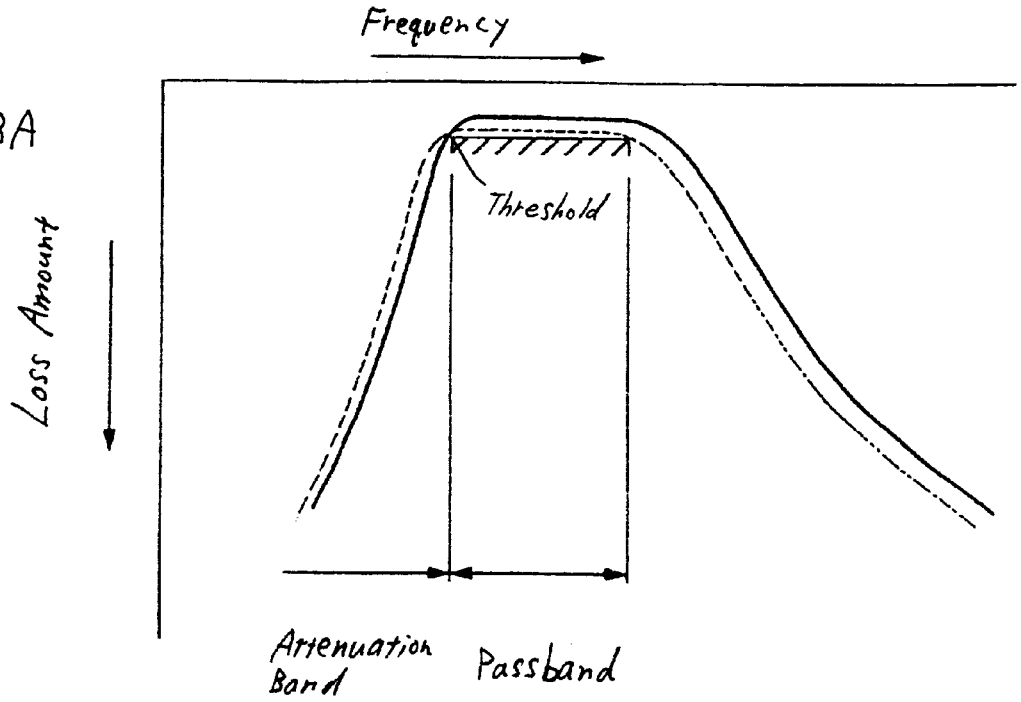
FIGS. 3A and 3B are pass characteristic graphs of the dielectric filter.
Figure 3B:
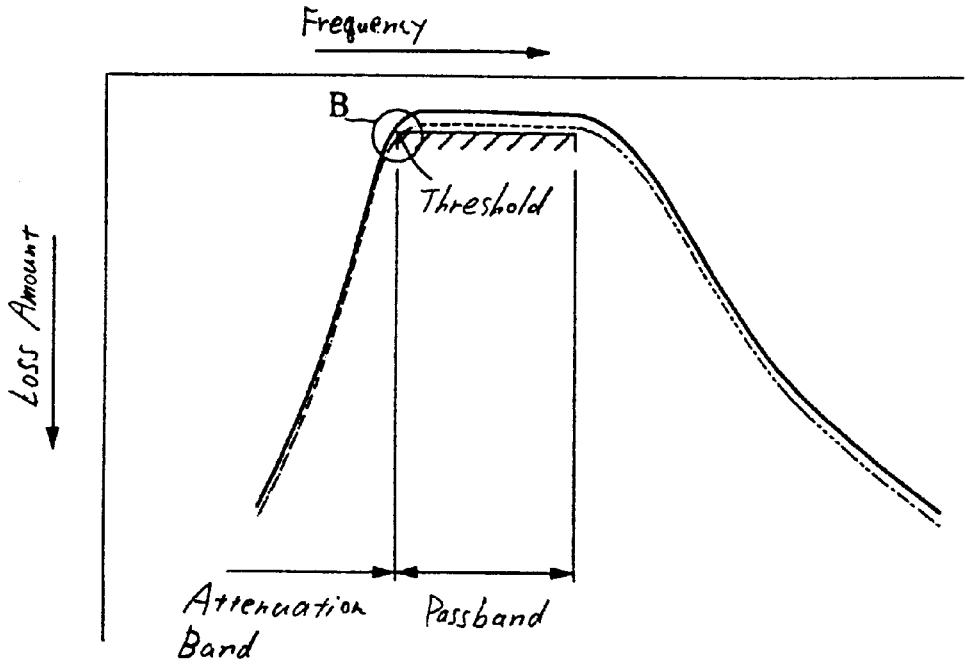

FIGS. 3A and 3B show graphs illustrating the pass characteristics of the dielectric filter. In this example, an attenuation pole is formed on the lower-frequency side of the pass band by the capacitive coupling, in which a steep attenuation characteristic is obtained in a region from the pass band to the attenuation band on the lower-frequency side. The hatched parts in the figure show maximum insertion losses and the frequency ranges thereof. At normal temperatures, the shoulder portions of the waveforms indicating the pass characteristics in the regions from the pass bands to the lower-frequency sides of the attenuation bands are in proximity to thresholds. However, the insertion losses in the pass bands, as indicated by solid lines in the graphs, are smaller than the maximum insertion losses. Although another threshold exists at the end of higher-frequency side of the hatched part, the higher-frequency side region of the pass band is not considered here.

The dielectric block has a positive permittivity-temperature coefficient. As a result, the pass characteristics of the dielectric filter at high temperatures move toward a low-frequency band direction, as indicated by a dotted line in each graph. In addition, according to the conductivity-temperature coefficient of an electrode, Qo is deteriorated and an insertion loss thereby increases. As a result, with temperature rise, the entire waveform of the pass characteristics moves toward a left-lower slanting direction in each graph. As shown in the FIG. 3A, even at high temperatures, the shoulder portion of the waveform exhibiting the pass characteristics does not go beyond the threshold.

If the dielectric filter is formed by using a dielectric material whose permittivity-temperature coefficient is approximately zero, since the pass characteristics move toward the lower direction in the graph, as shown in FIG. 3B, the shoulder portion indicated by the symbol B goes beyond the threshold at a certain temperature.

Figure 4:
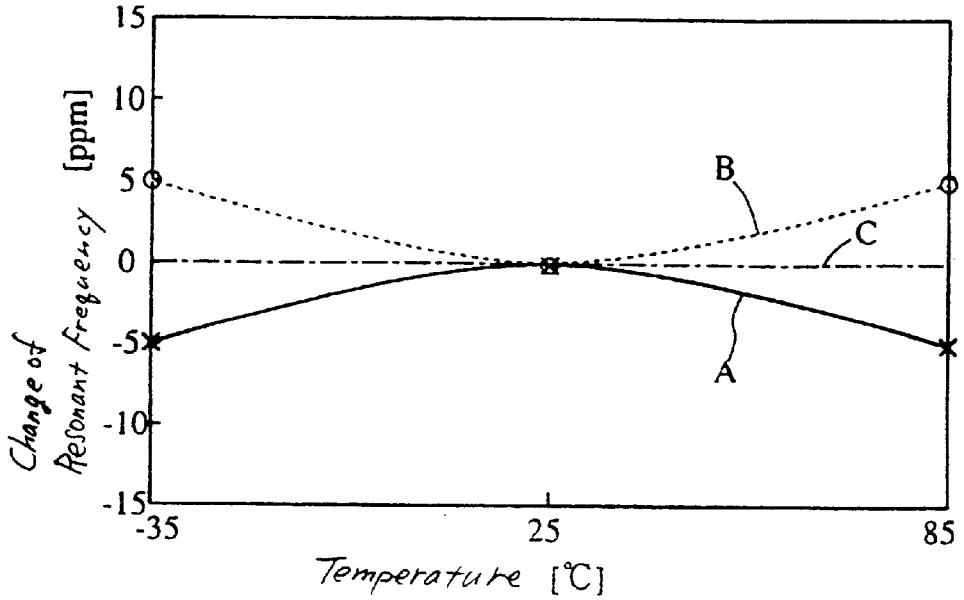
FIG. 4 is a graph showing an example of frequency-temperature changes according to the difference in dielectric materials.

FIG. 4 shows the temperature characteristics of two dielectric materials. Regarding the resonant frequency of a dielectric resonator using the dielectric material exhibiting the characteristics indicated by a solid line, when 25° C. is a reference temperature, as the temperature becomes higher than that, the resonant frequency is reduced, in which when the temperature is +85° C., the resonant frequency changes by −5 ppm. Even when the temperature is lower than 25° C., the resonant frequency is reduced, in which when the temperature is 35° C., the resonant frequency changes by −5 ppm. In addition, regarding the resonant frequency of a dielectric resonator using the dielectric material exhibiting the characteristics indicated by a dotted line in the graph, when 25° C. is a reference temperature, as the temperature becomes higher than that, the resonant frequency is increased, in which when the temperature is +85° C., the resonant frequency changes by +5 ppm. Even when the temperature is lower than 25° C., the resonant frequency is increased, in which when the temperature is −35° C., the resonant frequency changes by +5 ppm. Furthermore, when the dielectric resonator is formed by using a dielectric material exhibiting the characteristics indicated by a dash-single-dot line in the graph, the resonant frequency of the resonator does not almost change over the range of −35° C. and +85° C.

In FIG. 4, as a dielectric material exhibiting the upwardly-protruded type characteristics, $BaO—PbO—Nd_2O_3—TiO_2$ can be used.

As a dielectric material exhibiting the downwardly-protruded type characteristics, $BaO—Bi_2O_3—Nd_2O_3—Sm_2O_3—TiO_2$ can be used.

As a dielectric material exhibiting the flat characteristic, $BaO—PbO—Bi_2O_3—Nd_2O_3—TiO_2$ can be used. In addition, a permittivity-temperature coefficient (a frequency-temperature coefficient in the case of a dielectric filter) can be arbitrarily determined by changing the compositional ratios of these materials. Such a resonant frequency/temperature change is determined by the permittivity-temperature coefficient of the dielectric block. However, in general, since the temperature characteristics of a dielectric material is obtained by measuring a resonant frequency obtained when a dielectric resonator is formed, the temperature characteristics of a dielectric material are indicated by a frequency/temperature coefficient (hereinafter referred to as TC).

In the dielectric filter having the characteristics shown in FIG. 3A, the frequency is lowered as the temperature increases up to 25° C. or higher, as indicated by the symbol A shown in FIG. 4. In other words, a dielectric material in which TC is less than 0 is used.

Next, the structure of a dielectric filter according to a second embodiment will be illustrated by referring to FIGS. 5A to 7.

Figure 5A:
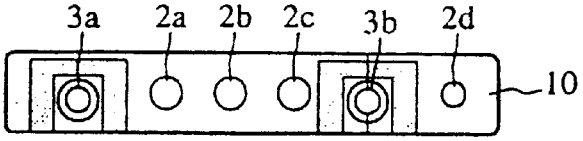
FIGS. 5A, 5B, 5C and 5D are projection viewes of a dielectric filter according to a second embodiment of the present invention.
Figure 5B:
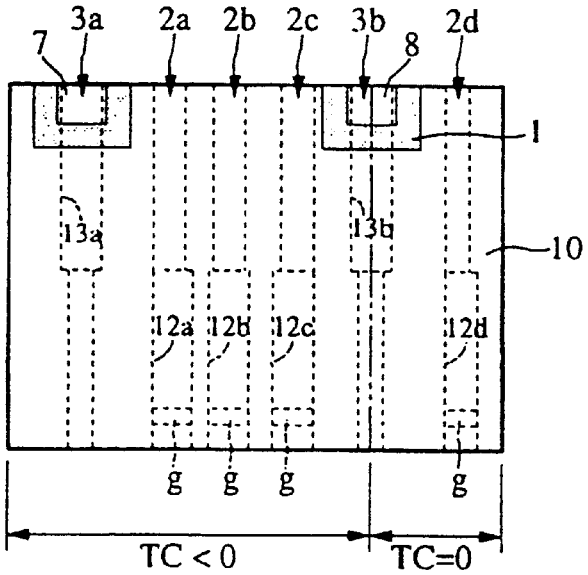
Figure 5D:
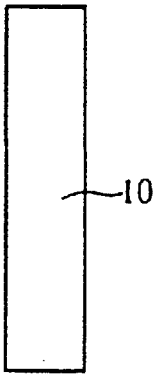
Figure 5C:
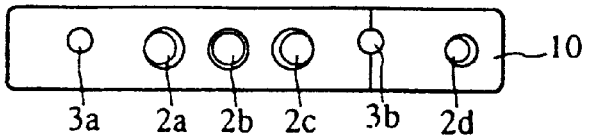

FIGS. 5A to 5D are projection views of the dielectric filter, in which FIG. 5A is a plan view, FIG. 5B is a front view, FIG. 5C is a bottom view, and FIG. 5D is a right side view. When the dielectric filter is mounted on a printed circuit board as a component, the front view shown in FIG. 5B is a surface mounted with respect to the printed circuit board.

The dielectric filter is formed by disposing various holes and electrodes with respect to a rectangular parallelepiped dielectric block 1. Unlike the structure shown in FIG. 1, in this embodiment, a resonant-line hole 2*d* is additionally disposed in the dielectric block 1, and a resonant line 12*d* is formed on the inner surface of the resonant-line hole 2*d*. Furthermore, at substantially the center of the input/output coupling line hole 3*b*, there is given a boundary position, by which the dielectric block in the direction of the resonant-line hole 2*d* has a material in which TC is 0, and the dielectric block in the other region has a material in which TC is smaller than 0. The other structural parts are the same those shown in FIG. 1. When the dielectric block is formed, the dielectric material in which TC is smaller than 0 and the dielectric material in which TC is 0 are integrally molded and fired. In this case, since the dielectric materials, whose basic compositions are the same, are molded and fired, the performances are substantially the same. As a result, molding and firing can be simultaneously conducted.

The operation of the dielectric filter shown in FIGS. 5A to 5D will be illustrated as follows. First, resonant lines 12*a*, 12*b*, and 12*c* formed in resonant-line holes 2*a*, 2*b*, and 2*c* are capacitively coupled. As in the case of the first embodiment, the resonant lines 12*a*, 12*b*, and 12*c* are coupled by a combination of the comb-line coupling (inductive coupling) formed by the stray capacitances Cs of electrodeless portions g and the capacitive coupling formed by stepped holes. In this case, since a relationship of inductive coupling<capacitive coupling is provided, the resonant lines 12*a*, 12*b*, and 12*c* are capacitively coupled overall. Interdigital coupling is each formed between the resonant line 12*a* and an input/output coupling line 13*a* and between the resonant line 12*c* and an input/output coupling line 13*b*. With this arrangement, the part between input/output terminals 7 and 8 serves as a band pass filter. A resonant line 12*d* is interdigitally coupled to the input/output coupling line 13*b* to serve as a trap resonator.

Figure 6:
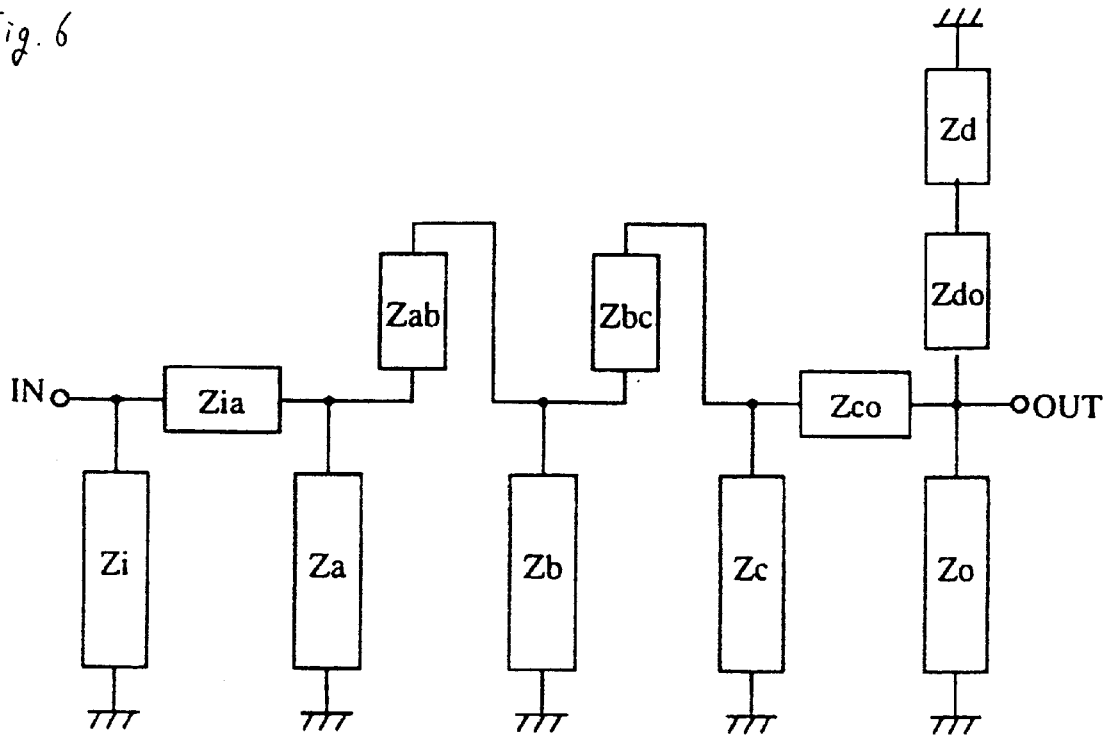
FIG. 6 is an equivalent circuit diagram of the dielectric filter.

FIG. 6 is an equivalent circuit diagram of the dielectric filter, in which the symbol Zd denotes an impedance generated by the resonant line 12*d*, and the symbol Zdo denotes an impedance generated by the mutual capacitance generated between an impedance Zo generated by the input/output coupling line 13*b* and the resonant line 12*d*. The other parts are the same as those in the equivalent circuit shown in FIG. 2.

Figure 7:
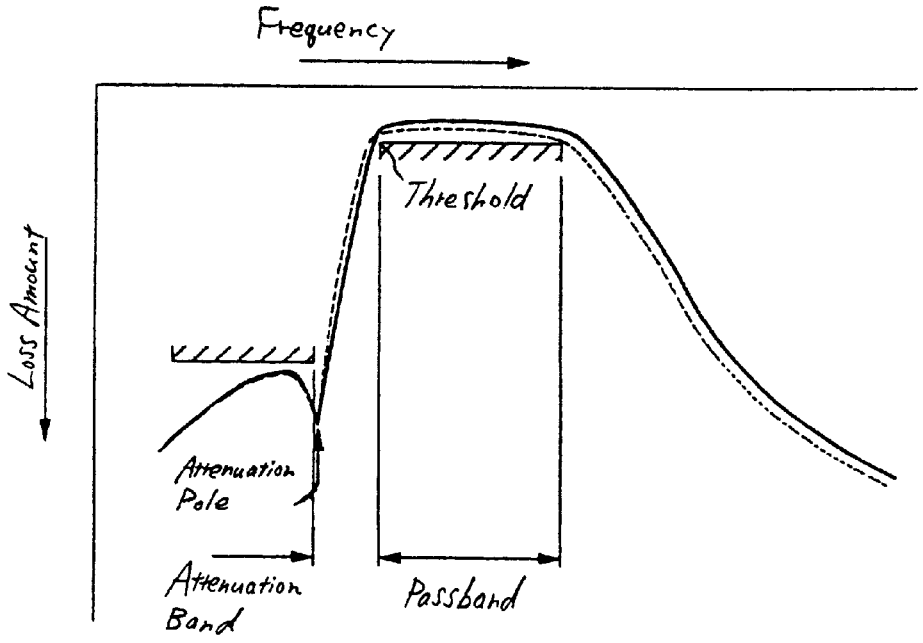
FIG. 7 is a pass characteristic graph of the dielectric filter.

FIG. 7 is a graph illustrating the pass characteristics of the dielectric filter. In this embodiment, an attenuation pole is generated by the resonant line 12*d* serving as the trap resonator. With this arrangement, a steep attenuation characteristic is exhibited in a range from the pass band to the attenuation band of the lower-frequency side. The hatched part in the pass band shown in the figure indicates a maximum insertion loss and the frequency range thereof, and the hatched part in the attenuation band indicates a minimum attenuation and the frequency range thereof. At normal temperatures, although the shoulder portion in a region from the pass band of a waveform exhibiting the pass characteristics to the attenuation band of the lower-frequency side thereof is in proximity to a threshold, an insertion loss in the pass band is smaller than the maximum insertion loss, as indicated by a solid line in the figure. As shown in FIG. 5, since the TC of the dielectric material of the band pass filter section is smaller than zero, the waveform exhibiting the pass characteristics of the dielectric filter at high temperatures moves toward a left-lower slanting direction overall, as indicated by a dotted line in the figure. In this situation, the shoulder portion of the waveform exhibiting the pass characteristics does not go beyond the threshold. In addition, since the TC of the dielectric material of the resonant-line hole 2*d* is equal to 0, the frequency of an attenuation pole is fixed regardless of temperature changes. With this arrangement, the attenuation in the attenuation band can be constantly provided, and the determined minimum attenuation in the attenuation band can thereby be constantly provided.

Figure 8:
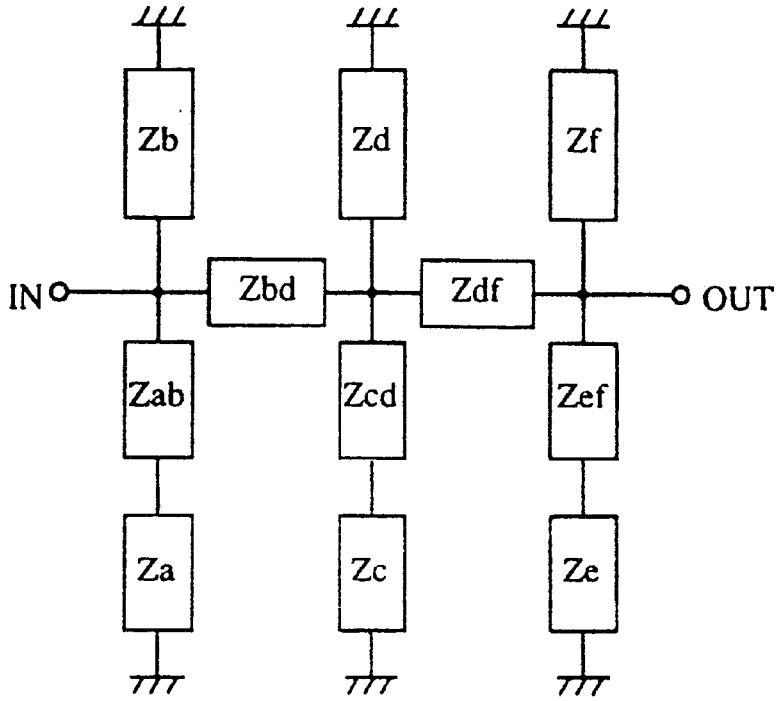
FIG. 8 is an equivalent circuit diagram of a dielectric filter according to a third embodiment of the present invention.
Figure 9:
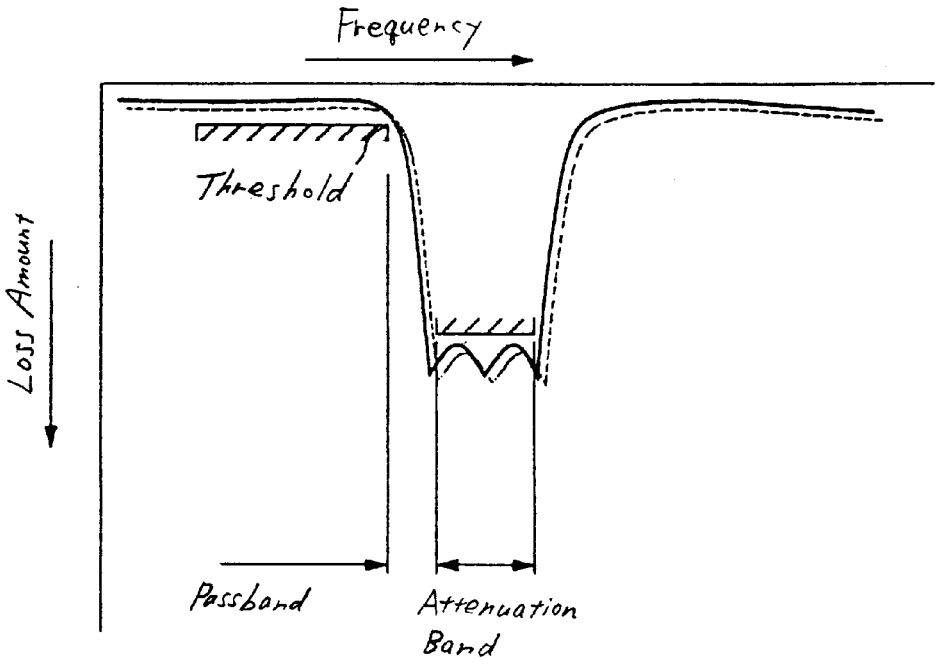
FIG. 9 is a pass characteristic graph of the dielectric filter.

Next, the structure of a dielectric filter according to a third embodiment will be illustrated by referring to FIGS. 8 and 9.

Although the above embodiments use dielectric filters having pass-band characteristics, similarly, band-block type dielectric filters can also be applied. FIG. 8 shows an equivalent circuit of a band-block type dielectric filter. In the figure, the symbols Zb, Zd, and Zf denote each impedance of resonant lines, and the symbols Zbd and Zdf denote each impedance generated by the mutual capacitance obtained when these lines are interdigitally coupled. In addition, the symbols Za, Zc, and Ze denote each impedance of the resonant lines as trap resonators, and the symbol Zab denotes an impedance generated by the mutual capacitance between resonators Za and Zb to operate as a $\pi/2$ phase circuit, by which (Za and Zab) operate as a trap resonator. Similarly, the symbol Zcd denotes an impedance generated by the mutual capacitance between, resonators Zd and Zc, by which (Zc and Zcd) operate as a trap resonator; and the symbol Zef denotes an impedance generated by the mutual capacitance between resonators Zf and Ze, in which (Zf and Zef) operate as a trap resonator. Thus, this is a structure in which the trap resonators of three stages are coupled.

FIG. 9 is a graph illustrating the pass characteristics of the dielectric filter. In this figure, the shoulder portion of the pass characteristics in a region from the pass band to the attenuation band is in proximity to a threshold. The TC of the dielectric material of a dielectric block is larger than 0. As a result, at high temperatures, the waveform of the pass characteristics moves toward a right-lower slanting direction, as indicated by a dotted line. With this arrangement, even at high temperatures, the shoulder of the waveform does not go beyond the maximum value of pass losses.

Next, the structure of a dielectric duplexer according to a fourth embodiment of the present invention will be illustrated by referring to FIGS. 10A to 12.

Figure 10A:
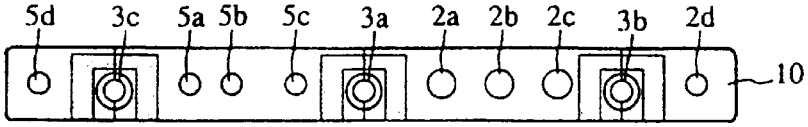
FIGS. 10A, 10B, 10C and 10D are projection views of a dielectric duplexer according to a fourth embodiment of the present invention.
Figure 10B:
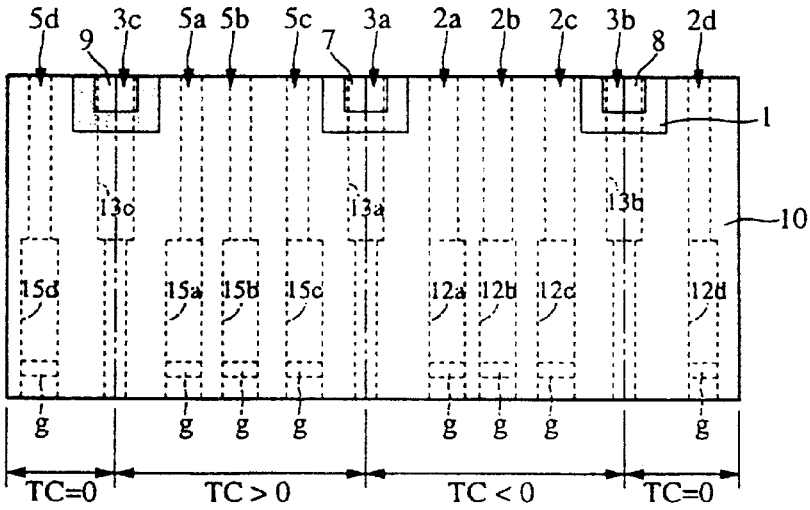
Figure 10D:
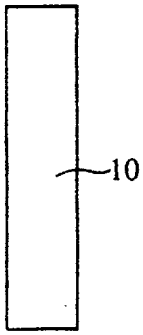
Figure 10C:
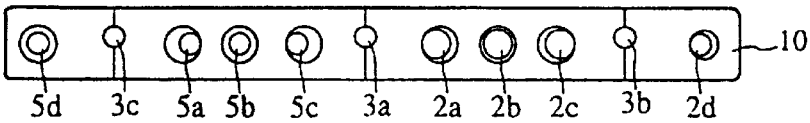

FIGS. 10A to 10D are projection views of the dielectric duplexer, in which FIG. 10A is a plan view, FIG. 10B is a front view, FIG. 10C is a bottom view, and FIG. 10D is a right side view. When this dielectric duplexer is mounted on a printed circuit board as a component, the front surface shown in FIG. 10B is a surface to be mounted with respect to the printed circuit board.

The above dielectric duplexer is formed by disposing various holes and electrodes with respect to a rectangular parallelepiped dielectric block 1. To put it concretely, reference numerals 2*a*, 2*b*, and 2*c* denote resonant-line holes, on the inner surfaces of which resonant lines 12*a*, 12*b*, and 12*c* are formed. Similarly, reference numerals 5*a*, 5*b*, and 5*c* denote resonant-line holes, on the inner surfaces of which resonant lines 15*a*, 15*b*, and 15*c* are formed. In addition, reference numerals 3*a*, 3*b*, and 3*c* denote input/output coupling line holes, on the inner surfaces of which input/output coupling lines 13*a*, 13*b*, and 13*c* are formed. These holes are stepped holes in which the inner diameters of the holes are changed at a certain point thereof. On an outer surface of the dielectric block 1, input/output terminals 7, 8, and 9 continuing from the input/output coupling line holes 13*a*, 13*b*, and 13*c* are formed, and on substantially the entire surfaces (six surfaces) except the parts of these input/output terminals, ground electrodes 10 are formed. Furthermore, near the ends of the large-diameter side of the stepped holes having the resonant lines 12*a*, 12*b*, 12*c*, 15*a*, 15*b*, and 15*c*, electrodeless portions (nonconductive portions) indicated by. the symbol "g" are disposed, at each of which a stray capacitance (Cs) is generated.

The above-described dielectric block 1 has four dielectric-material regions including TC=0, TC>0, TC<0, and TC=0, as shown in FIG. 10B.

Next, the operation of the dielectric duplexer will be illustrated as follows. First, the resonant lines 12*a*, 12*b*, and 12*c* formed in the resonant-line holes 2*a*, 2*b*, and 2*c* are inductively coupled. The resonant lines 12*a*, 12*b*, and 12*c* are coupled by a combination of the comb-line coupling (inductive coupling) formed by the stray capacitance Cs of the electrodeless portions g and the capacitive coupling formed by the stepped holes. However, in this case, a relationship of the inductive coupling>the capacitive coupling is provided, the resonant lines 12*a*, 12*b*, and 12*c* are inductively coupled overall. Interdigital coupling is each formed between the resonant line 12*a* and the input/output coupling line 13*a* and between the resonant line 12*c* and the input/output coupling line 13*b*. In addition, interdigital coupling is formed between a resonant line 12*d* and an input/output coupling line 13*b*.

Meanwhile, the resonant lines 15*a*, 15*b*, and 15*c* are capacitively coupled. The resonant lines 15*a*, 15*b*, and 15*c* are coupled by a combination of the comb-line coupling (inductive coupling) formed by the stray capacitance Cs of electrodeless portions g and the capacitive coupling formed by the stepped holes. In this case, since there is provided a relationship of inductive coupling<capacitive coupling, the resonant lines 15*a*, 15*b*, and 15*c* are capacitively coupled overall. Interdigital coupling is each formed between the resonant line 15*a* and the input/output coupling line 13*c* and between the resonant line 15C and the input/output coupling line 13*a*, and interdital coupling is formed between a resonant line 15*d* and the input/output coupling line 13*c*.

Figure 11:
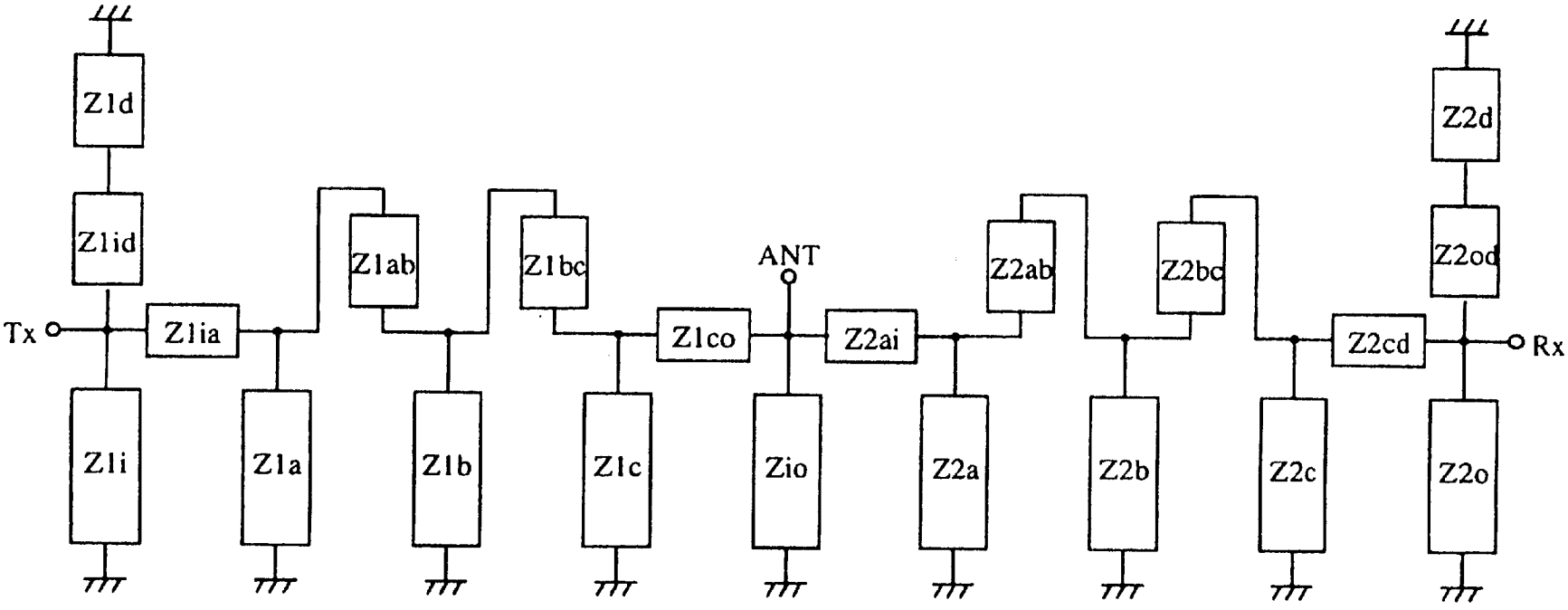
FIG. 11 is an equivalent circuit diagram of the dielectric duplexer.

FIG. 11 is an equivalent circuit diagram of the dielectric filter described above. The symbols Z1*a*, Z1*b*, and Z1*c* denote each impedance generated by the resonant lines 15*a*, 15*b*, and 15*c* shown in FIG. 10, the symbol Z1*d* denotes an impedance generated by the resonant line 15*d*, the symbol Z2*d* denotes an impedance generated by the resonant line 12*d*. The symbols Z2*a*, Z2*b*, and Z2*c* denote each impedance generated by the resonant lines 12*a*, 12*b*, and 12*c* shown in FIG. 10, and the symbols Z1*i*, Zio, Z2*o* denote each impedance generated by the input/output coupling lines 13*c*, 13*a*, and 13*b* shown in FIG. 1. The symbol Z1*id* denotes an impedance generated by the mutual capacitance generated between the resonant line 15*d* and the input/output coupling line 13*c*, and the symbol Z2*od* denotes an impedance generated by the mutual capacitance generated between the resonant line 12*d* and the input/output coupling line 13*b*. The symbol Z1*ab* denotes an impedance generated by the mutual capacitance generated between the resonant lines 15*a* and 15*b*, the symbol Z1*bc* denotes an impedance generated by the mutual capacitance generated between the resonant lines 15*b* and 15*c*, the symbol Z2*ab* denotes an impedance generated by the mutual capacitance generated between the resonant lines 12*a* and 12*b*, and the symbol Z2*bc* denotes an impedance generated by the mutual capacitance generated between the resonant lines 12*b* and 12*c*. Furthermore, the symbol Z1*co* denotes an impedance generated by the mutual capacitance generated between the resonant line 15*c* and the input/output coupling line 13*a*, and the symbol Z2*ai* denotes an impedance generated by the mutual capacitance generated between the resonant line 12*a* and the input/output coupling line 13*a*.

In this way, each of a transmitting filter and a receiving filter is formed by the resonators of three stages and the trap resonator of one stage.

Figure 12A:
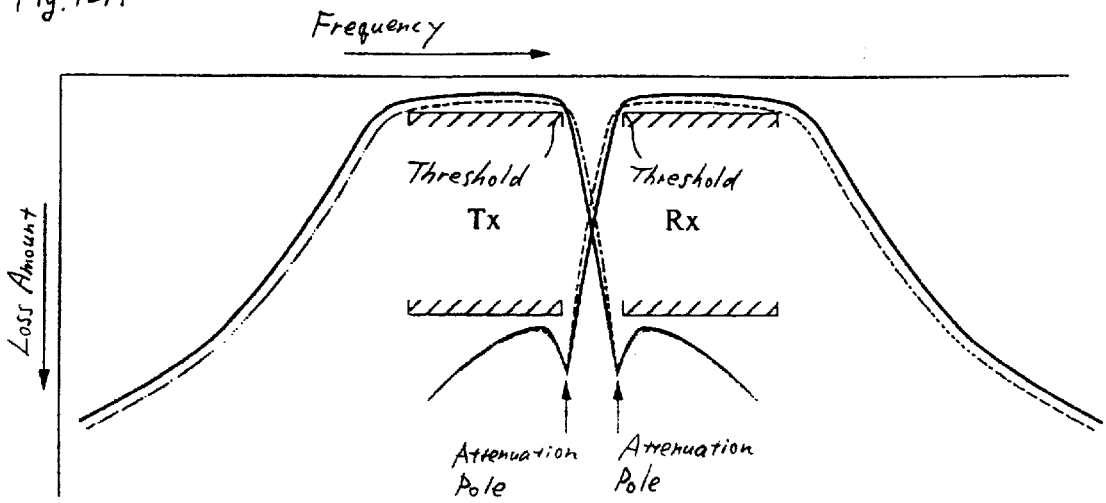
FIGS. 12A and 12B are pass characteristic graphs of the dielectric duplexer.
Figure 12B:
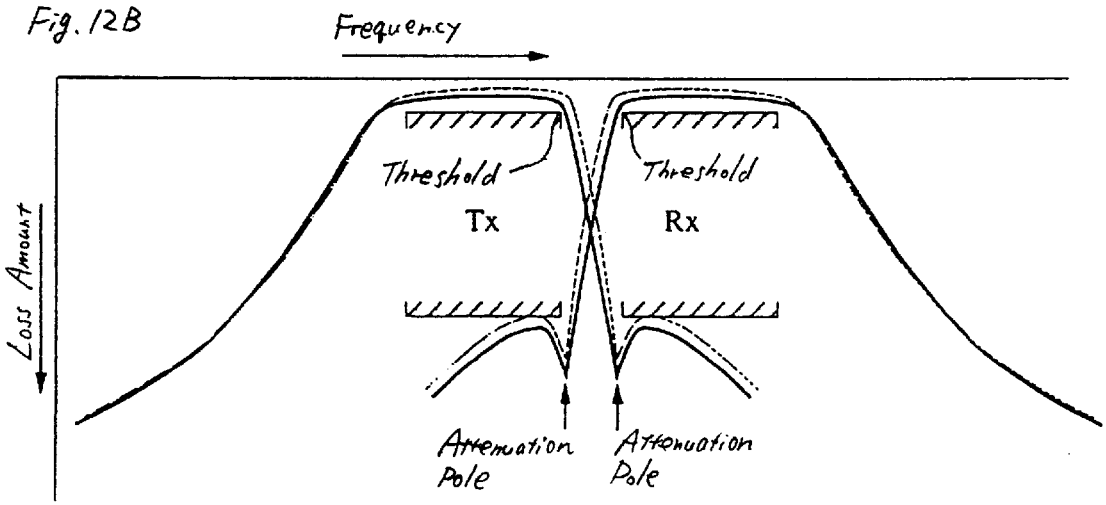

FIGS. 12A and 12B are graphs illustrating the pass characteristics of the dielectric duplexer. In this example, a transmitting filter allows signals of a transmitting band to pass through, and allows signals of a receiving band on the high-frequency side to be attenuated. The receiving filter allows signals of the receiving band to pass through and allows signals of the transmitting band on the low-frequency side to be attenuated. In the transmitting filter, an attenuation band made by the above-described trap resonator is formed on the high-frequency side of the pass band, and in the receiving filter, an attenuation band made by the above-described trap resonator is formed on the low-frequency side of the pass band.

The hatched parts in each graph indicate maximum insertion :losses and minimum attenuations, and the frequency ranges thereof. At normal temperatures, the shoulder portions in regions from the pass bands to the attenuation bands of waveforms exhibiting pass characteristics are in proximity to thresholds. However, the insertion losses in the pass bands are smaller than the maximum insertion losses, as indicated by solid lines in the figure.

The TC is larger than 0 in the dielectric material of the resonator part producing the band pass characteristics of the transmitting filter. Therefore, the waveform exhibiting the pass characteristics of the transmitting filter at high temperatures moves toward a right-lower slanting direction, as indicated by a dotted line. As a result, as shown in FIG. 12A, even at high temperatures, in the transmitting filter, the shoulder portion of the waveform exhibiting the pass characteristics does not go beyond the threshold. In addition, the TC is smaller than 0 in the dielectric material of the resonator part producing the band pass characteristics of the receiving filter. Therefore, the waveform exhibiting the pass characteristics of the receiving filter at high temperatures moves toward a left-lower slanting direction. As a result, as shown in FIG. 12A, even at high temperatures, in the receiving filter, the shoulder portion of the waveform exhibiting the pass characteristics does not go beyond the threshold. Furthermore, since the TC is equal to 0 in the dielectric material of the resonator parts producing the band pass characteristics of each of the transmitting filter and the receiving filter, even at high temperatures, it is possible to constantly provide an attenuation in the receiving band of the transmitting filter and an attenuation in the transmitting band of the receiving filter.

A material indicated by the symbol B in FIG. 4 is used as the dielectric material of the resonator part producing the band pass characteristics of the above transmitting filter, and a material indicated by the symbol A in FIG. 4 is used as the dielectric material of the resonator part producing the band pass characteristics of the above receiving filter. As a result, at temperatures lower than 25° C., as shown in FIG. 12B, the pass band characteristics of the transmitting filter move toward a right-upper slanting direction in the figure, and the pass band characteristics of the receiving filter move toward a left-upper slanting direction in the figure. Accordingly, at lower temperatures, insertion losses in both the transmitting filter and the receiving filter are more satisfactory.

Figure 13:
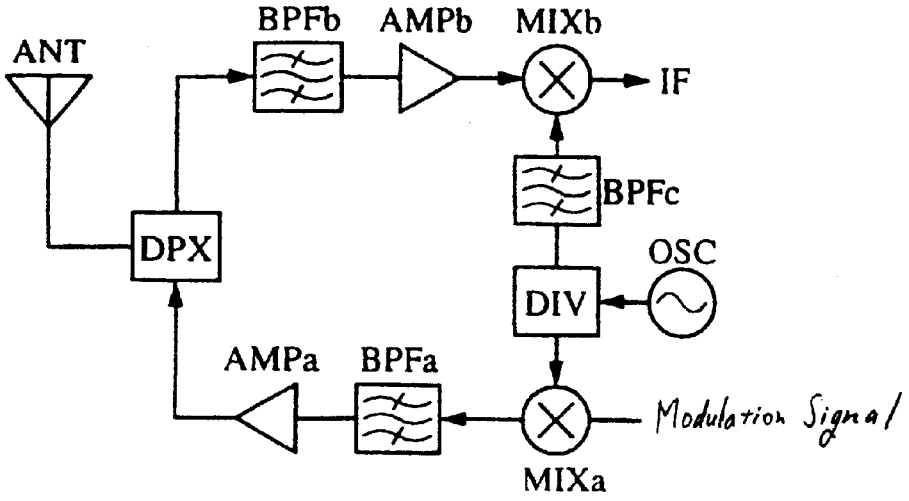
FIG. 13 is a block diagram showing the structure of a communication apparatus according to a fifth embodiment of the present invention.
Figure 14A:
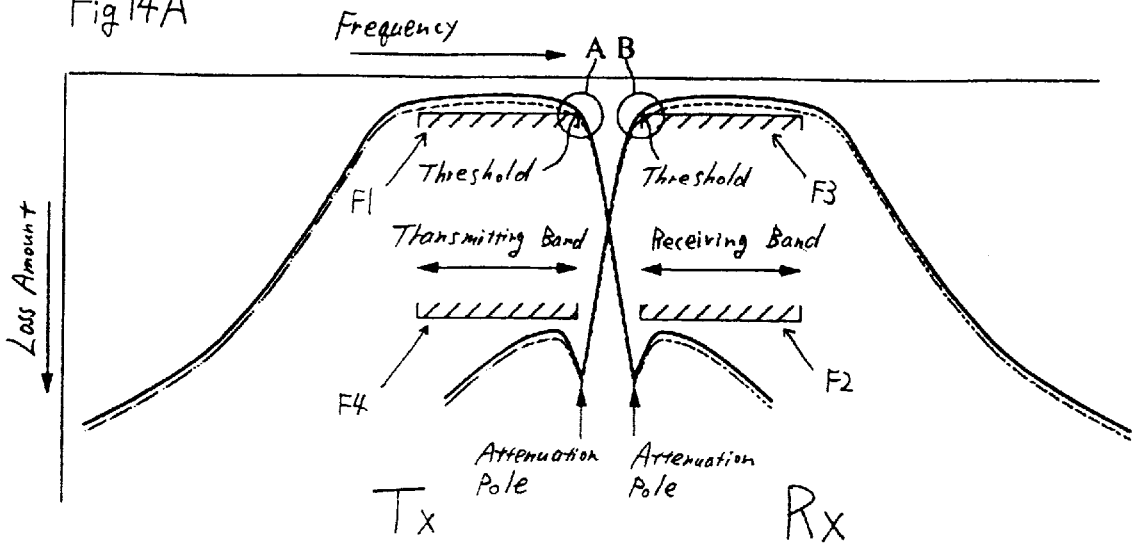
FIGS. 14A and 14B are pass characteristic graphs of a conventional dielectric duplexer.
Figure 14B:
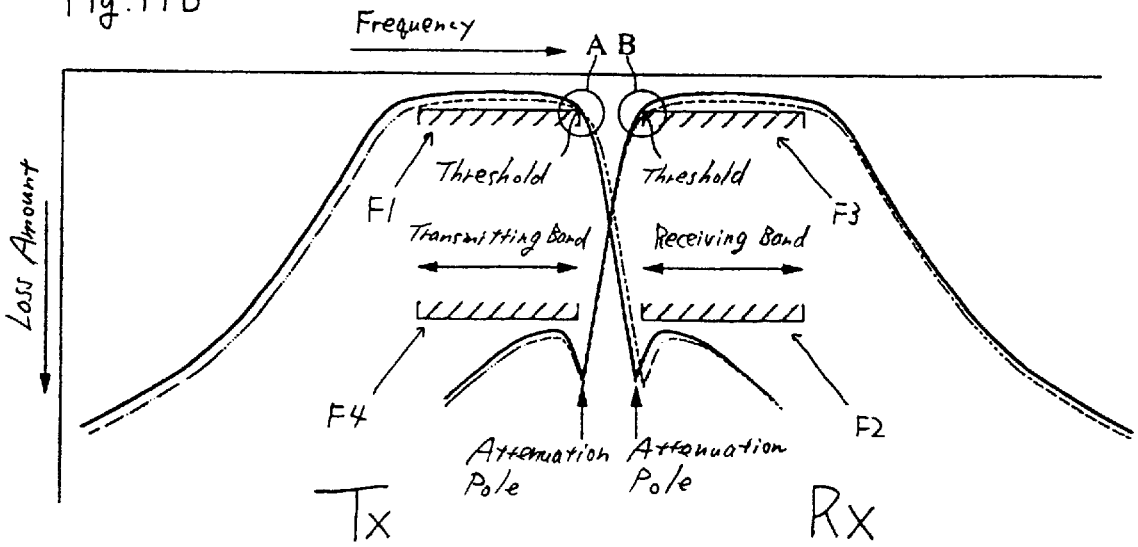

FIG. 13 is a block diagram illustrating the structure of a communication apparatus according to a fifth embodiment. In this figure, the symbol ANT denotes a transmitting/receiving antenna, the symbol DPX denotes a duplexer, the symbols BPFa, BPFb, and BPFc are band pass filters, the symbols AMPa and AMPb denote amplifying circuits, the symbols MIXa and MIXb denote mixers, the symbol OSC denotes an oscillator, and the symbol DIV denotes a frequency divider (a synthesizer). MIXa modulates a signal frequency outputted from DIV by a modulation signal, BPFa allows only the signals of a transmitting-frequency band to pass through, and AMPa power-amplifies the signals to transmit from ANT via DPX. BPFb allows only the receiving-frequency-band signals. of the signals outputted from DPX to pass through, and AMPb power-amplifies the passed signals. MIXb performs mixing of frequency signals outputted from BPFc and received signals to output intermediate frequency signals IF.

As the duplexer DPX shown in FIG. 13, it is possible to use a dielectric duplexer having the structure shown in FIGS. 10A to 10D. In addition, as the band pass filters BPFa, BPFb, and BPFc, it is possible to use the dielectric filter having the structure shown in FIGS. 5A to 5D. In this way, an overall compact communication apparatus is produced.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

an attenuation band in proximity to a pass band;

a threshold-frequency position of a determined maximum insertion loss being arranged close to a shoulder portion of a waveform exhibiting pass band characteristic in which insertion losses increase in a region from the pass band to the attenuation band;

temperature characteristics of a dielectric material being determined in such a manner that the shoulder portion moves toward the attenuation-band direction according to an increase and decrease in temperature;

wherein the dielectric filter further comprises a plurality of dielectric resonators, at least one of the dielectric resonators being a trap resonator forming an attenuation pole in a region from the shoulder portion to the attenuation band, and temperature characteristics of the dielectric material are determined in such a manner that resonant-frequency changes with respect to temperature changes in the trap resonator are smaller than those with respect to temperature changes in the other dielectric resonator.

2. The dielectric filter according to claim 1, wherein the plurality of the dielectric resonators are integrally molded or integrally fired as s single dielectric block.

3. The dielectric filter according to claim 1, wherein the dielectric filter is a band pass filter comprising a plurality of dielectric resonators in which the pass band is used as the range of a resonant frequency.

4. The dielectric filter according to claim 1, wherein the dielectric filter is a band block filter comprising a plurality of dielectric resonators in which the attenuation band is used as the range of a resonant frequency.

5. A dielectric duplexer comprising two dielectric filters, each said dielectric filter being in accordance with one of claims 1, 3, and 4, one of the two filters being a dielectric filter, in which the low-frequency band of the filter is an attenuation band and the high-frequency band thereof is a pass band, and the other filter being a dielectric filter, in which the low-frequency band of the filter is a pass band and the high-frequency band thereof is an attenuation band.

6. A communication apparatus comprising at least one of a transmitting circuit and a receiving circuit, and connected to said circuit, a dielectric filter in accordance with one of claims 1 to 4.

7. The dielectric duplexer according to claim 5, wherein the two dielectric filters are integrally molded or integrally fired as a single dielectric block.

8. A communication apparatus comprising:

a transmitting circuit and a receiving circuit; and a duplexer in accordance with claim 5, wherein one of the two filters is connected to said transmitting circuit and the other of said two filters is connected to said receiving circuit.

9. The communication apparatus according to claim 8, wherein the two dielectric filters are integrally molded or integrally fired as a single dielectric block.

* * * * *